US008657401B2

(12) United States Patent
Tobita et al.

(10) Patent No.: US 8,657,401 B2
(45) Date of Patent: Feb. 25, 2014

(54) IMAGE FORMING APPARATUS WITH INK-JET PRINTING SYSTEM

(75) Inventors: Satoru Tobita, Kanagawa (JP); Kunihiro Yamanaka, Kanagawa (JP); Naoko Kitaoka, Kanagawa (JP); Takashi Satou, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/610,759

(22) Filed: Sep. 11, 2012

(65) Prior Publication Data

US 2013/0070010 A1 Mar. 21, 2013

(30) Foreign Application Priority Data

Sep. 15, 2011 (JP) ..... 2011-202159

(51) Int. Cl.
*B41J 29/38* (2006.01)

(52) U.S. Cl.
USPC ..... 347/11; 347/15

(58) Field of Classification Search
USPC ..... 347/9–11, 15, 44, 47
See application file for complete search history.

(56) References Cited

U.S. PATENT DOCUMENTS 6,618,159 B1 9/2003 Tobita et al.
7,396,096 B2 * 7/2008 Kobayashi et al. ..... 347/11
2006/0132548 A1 6/2006 Yamada et al.
2006/0268072 A1 11/2006 Yamada et al.
2007/0132813 A1 6/2007 Yamada et al.
2008/0150983 A1 6/2008 Sasaki

FOREIGN PATENT DOCUMENTS

JP 2005-144808 6/2005
JP 2006-218679 8/2006
JP 2006-218727 8/2006
JP 2006-231546 9/2006
JP 2006-272896 10/2006
JP 2007-182061 7/2007
JP 2008-37027 2/2008

* cited by examiner

*Primary Examiner* — Juanita D Jackson
(74) *Attorney, Agent, or Firm* — Cooper & Dunham LLP

(57) ABSTRACT

An image forming apparatus comprises a printing head unit, a driving waveform generator that generates and outputs a driving waveform having four or more driving pulses in chronological order per driving cycle, and a selector that selects and applies one of multiple driving pulses to a pressure generator to cause a printing head unit to selectively discharge a liquid droplet of three or more different sizes. The driving waveform includes three or more driving pulses at least having a final driving pulse to collectively discharge the biggest liquid droplet. The driving waveform includes a micro-driving pulse for discharging a smallest droplet within a time period of from about 2×Tc to about 4×Tc after the driving waveform starts being outputted when Tc represents a natural vibration period of a separate liquid chamber of the printing head unit.

20 Claims, 12 Drawing Sheets

IMAGE FORMING APPARATUS WITH INK-JET PRINTING SYSTEM

CROSS-REFERENCE TO RELATED APPLICATION

This patent application is based on and claims priority pursuant to 35 U.S.C. §119 to Japanese Patent Application No. 2011-202159, filed on Sep. 15, 2011 in the Japanese Patent Office, the entire disclosure of which is hereby incorporated by reference herein.

BACKGROUND OF THE INVENTION

1. Field of the Invention

This invention relates to an image forming apparatus, such as a printer, a facsimile machine, a photocopier, a multifunctional machine, a plotter, etc., employing an ink-jet printing system, and in particular to an image forming apparatus capable of precisely discharging a small droplet in the ink-jet printing system.

2. Description of the Background Art

As an image forming apparatus, such as a printer, a facsimile machine, a photocopying apparatus, a multifunctional machine, a plotter, etc., an ink-jet printing system is known that includes a liquid discharging head.

A system of driving the liquid discharging head provided in the image forming apparatus is known in which, it is now that a driving signal generator generates a driving signal having not only multiple driving pulses P1 and P3 to P7, for example, to discharge droplets from one or more nozzles, but also a micro-driving pulse P2, for example, only to vibrate a nozzle meniscus without discharging the droplets to maintain the nozzle or nozzles at each printing cycle. As these driving pulses P1 and P3 to P7 include, a resonance-driving pulse is employed to cause liquid to resonate in a pressure chamber and be discharged as a droplets therefrom, as well as a non-resonant-driving pulse is also employed to cause the liquid not to resonate but to be discharged as droplets of large and medium sizes as described in Japanese Patent Application Publication No. 2007-182061 (JP-2007-182061-A).

Also known is a technique in which a driving pulse is generated including a first expansion element P1 that inflates (i.e., expands) a pressure chamber having a fixed capacity, a first discharge element P3 that deflates (i.e., contracts) the pressure chamber inflated by the first expansion element P1 and discharges a droplet therefrom, a second expansion element P5 that expands the chamber again deflated by the first discharge element P3, and a second contraction element P7 that deflates the pressure chamber inflated by the second expansion element P5. Then, a time period "t" starting from a starting end of the first discharge element P1 until the last end of the second contraction element P7 is set to within a range of from ½ to 1 times a natural vibration period Tc of a pressure chamber storing liquid therein as described in Japanese Patent Application Publication No. 2008-037027 (JP-2008-037027-A).

However, when multiple droplets having different sizes, such as a large droplet, a medium droplet, a small droplet, etc., are discharged such that the small droplet is discharged in the next driving cycle (i.e., the next printing cycle) after the large or medium droplets are discharged (in the previous driving cycle), since kinetic energy thereof is weak, the small droplet immediately becomes susceptible to vibration of a meniscus in a nozzle and a velocity and an amount of the small droplet vary when discharged immediately after the large and medium droplets are discharged.

BRIEF SUMMARY OF THE INVENTION

Accordingly, the present invention provides a novel image forming apparatus that comprises a printing head unit, a driving waveform generator that generates and outputs a driving waveform having four or more driving pulses in chronological order per driving cycle, and a selector that selects and applies one of multiple driving pulses included in the driving waveform to a pressure generator to cause a printing head to selectively discharge three or more different sized liquid droplets. The driving waveform includes three or more driving pulses at least having a final driving pulse at the end of the driving waveform to collectively discharge the biggest liquid droplet. The driving waveform includes a micro-driving pulse for discharging a smallest droplet within a time period of from about 2×Tc to about 4×Tc after the driving waveform starts being outputted, when Tc represents a natural vibration period of a separate liquid chamber of the printing head. Further, the printing head includes multiple nozzles to eject liquid droplets, multiple separate liquid chambers communicating with the multiple nozzles, respectively, a common liquid chamber to supply liquid to the multiple separate liquid chambers, and a pressure generator to generate pressure to compress the liquid stored in the multiple separate liquid chambers.

In another aspect of the present invention, the driving pulse for discharging the smallest droplet is outputted within a time period of from about 3×Tc to about 4×Tc after the driving waveform starts being outputted.

In yet another aspect of the present invention, the final driving pulse among multiple-driving pulses of the driving waveform to discharge the biggest drops includes a first expansion waveform element used to increase a volume of the separate liquid chamber, a first holding waveform element to hold an expansion state of the separate liquid chamber, a contraction waveform element to decrease the volume of the separate liquid chamber to eject an liquid droplet, a second holding waveform element to hold the contraction state of the separate liquid chamber, and a second expansion waveform element to return a meniscus to the separate liquid chamber.

In yet another aspect of the present invention, the driving waveform includes the last driving pulse and an immediately preceding driving pulse to collectively discharge a medium size droplet between smallest and biggest droplet. Further, a starting point of the immediately preceding driving pulse is located at a time point later than a starting point of the driving pulse used to discharge the smallest droplet by about a value of about 2×Tc or more.

In yet another aspect of the present invention, an interval between starting points of the last and the immediately preceding driving pulses ranges from about 0.25×Tc to about 1.0×Tc.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
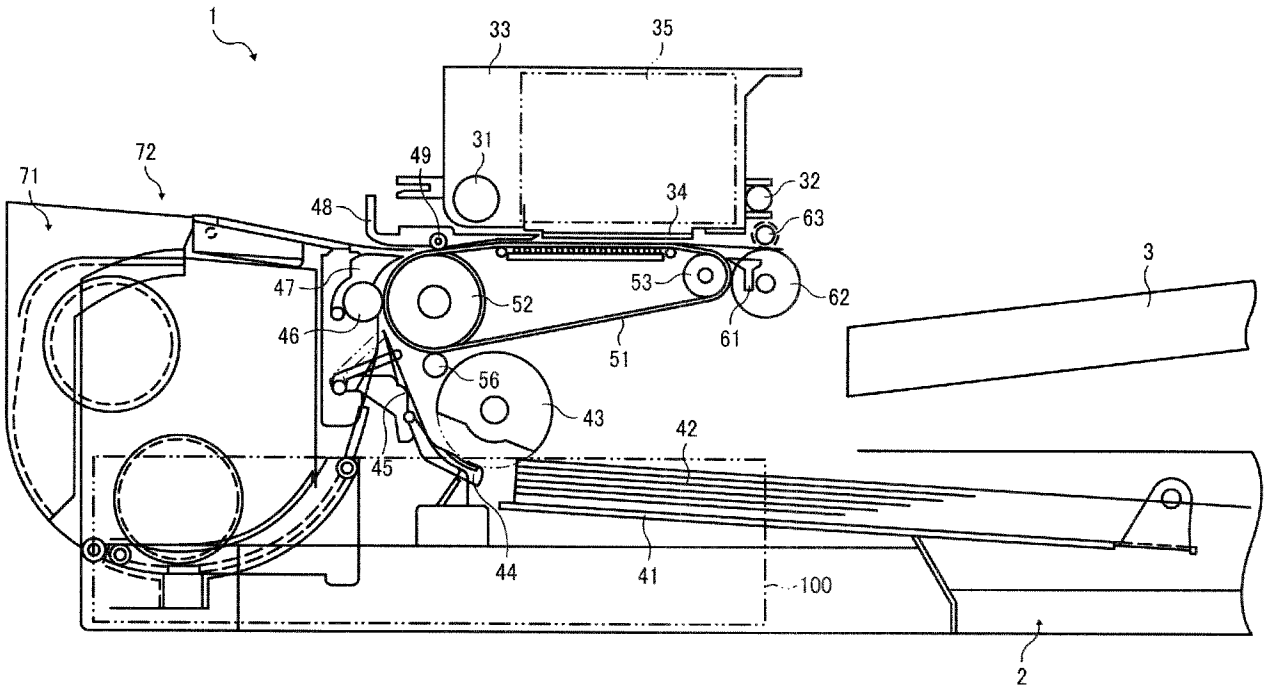
FIG. 1 is a schematic diagram illustrating the entire configuration of a mechanism of an image forming apparatus according to one embodiment of the present invention.
Figure 2:
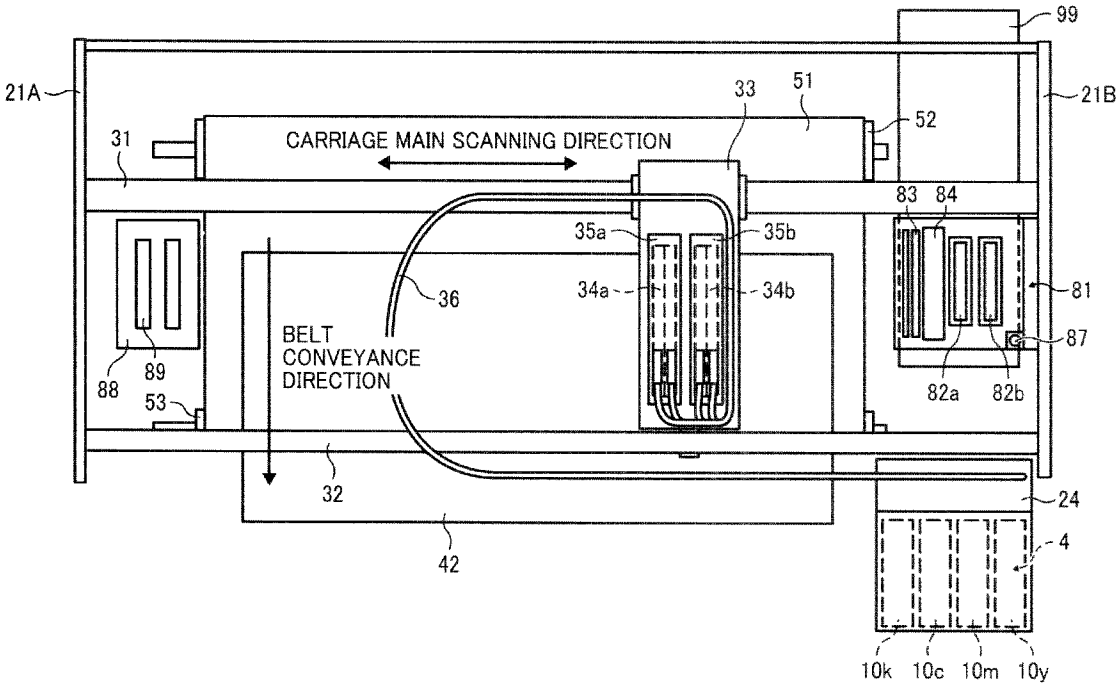
FIG. 2 is a plan view schematically illustrating the mechanism of FIG. 1.

Referring now to the drawings, wherein like reference numerals designate identical or corresponding parts throughout the several views thereof and in particular to FIGS. 1 and 2, an image forming apparatus of a serial type ink-jet printing system is described. The image forming apparatus slidingly holds a carriage 33 in a main scanning direction with main and sub guide rods 31 and 32 as a guide, horizontally supported by left and right side plates 21*a* and 21*b* of an apparatus main body 1. The image forming apparatus moves the carriage 33 and executes scanning using a main scanning motor, not shown, via a timing belt in a direction shown by arrow (i.e., a carriage main scanning direction).

The carriage 33 is provided with a pair of printing heads 34*a* and 34*b* as liquid discharge heads (herein after typically referred to as a printing head 34 when not distinguished) to collectively eject ink droplets of respective colors of yellow (Y), cyan (C), magenta (M), and black (K). Specifically, a nozzle array mainly consisting of multiple nozzles aligned in the sub-scanning direction is arranged orthogonal to the main scanning direction facing downward in an ink droplet discharging direction.

Each printing head 34 has two nozzle lines. One of the nozzle lines of the printing head 34*a* ejects droplets of black (K), and the other ejects droplets of cyan (C). One of the nozzle lines of the printing head 34*b* ejects droplets of magenta (M), and the other ejects droplets of yellow (Y). As a modification of the printing head 34, multiple nozzle lines for respective colors can be arranged on one nozzle surface.

The carriage 33 is equipped with head tanks 35*a* and 35*b* (hereinafter simply referred to as a head tank 35 when not distinguished) as second ink supplying units for supplying ink of respective colors to the nozzle lines of the printing head 34. To the head tank 35, printing liquid of each color is supplied and replenished by a supply pump unit 24 from each of ink cartridges (i.e., main tanks) 10*y* to 10*k* detachably attached to a color cartridge loading unit 4 through a feed tube 36 per color.

As a sheet feeder feeding a sheet loaded on a sheet loading unit (e.g. a pressure plate) 41 of the sheet feeding tray 2, a half moon-shape roller (e.g. a feed roller) 43 for separating and feeding the sheet 42 one by one from the sheet loading unit 41 and a separation pad 44 made of a large coefficient friction material being opposed to the feed roller 43 are provided. The separation pad 44 is biased toward the sheet feed roller 43.

To transfer the sheet 42 fed from the sheet feeder to a position below the printing head 34, a guide 45 to guide a sheet 42, a counter roller 46, a transfer guide 47, and a pressing member 48 having a leading end-pressing roller 49 are provided. A conveying belt 51 is also provided for the same reason to electrostatically adsorb and transport the sheet 42 as a transportation device to a position opposed to the printing head 34.

The conveying belt 51 is an endless-belt and is stretched around between a conveyor roller 52 and a tension roller 53 and circulates in a belt conveyor direction (i.e., a sub-scanning direction). A discharging roller 56 is provided as a discharging device to discharge the surface of the conveyor belt 51. The discharging roller 56 contacts the surface of the conveyor belt 51, and is driven and rotated by the conveyor belt 51 when it rotates. The conveying belt 51 circulates in the belt conveyor direction as shown in FIG. 2 when a sub-scanning motor, not shown, drives and rotates the conveyance roller 52 through a timing belt.

Further, as a sheet exit unit to eject a printed sheet 42 with an image printed by the printing head 34 and transported from the conveyor belt 51, a separation pick 61 for separating the sheet 42, an exit roller 62, and a spur 63 as a sheet exit roller are provided. A sheet exit tray 3 is further provided below the sheet exit roller 62.

A duplex unit 71 is detachably attached to a rear side of the apparatus main body 1. The duplex unit 71 takes in and reverses the sheet 42 returned by the conveying belt 51 when it rotates in a reverse direction upside down, and further feeds the sheet again to a position between the counter roller 46 and the conveyor belt 51. An upper surface of the duplex unit 71 serves as a manual feed tray 72.

A maintenance recovery mechanism 81 for keeping a condition including recovery of a nozzle of a printing head 34 is placed in a non-printing region of the carriage 33 at one side in the scanning direction thereof. The maintenance recovery mechanism 81 includes caps 82*a* and 82*b* (hereinafter simply referred to as a "cap" when not distinguish) to cap nozzle surfaces of the printing heads 34, respectively, a wiper (e.g. a wiper blade) for wiping the nozzles surface, a trial discharge ink receiver 84 for receiving a thickened liquid droplet not contributing to printing and discharged to be drained as trial discharging, and a carnage-lock 87 to lock the carriage 33. An effluent tank 99 is also detachably attached to the apparatus main body below the maintain recovery mechanism 81 of the head to accommodate effluent produced by the maintenance recovery.

A trial discharge ink receiver 88 is placed in a non-printing region of the carriage 33 at the other side in the scanning direction thereof to receive a thickened liquid droplet not contributing to printing and discharged during printing to be drained. Multiple openings 89 are provided on the trial discharge ink receiver 88 in a direction of the nozzle array of the printing head 34.

In the image forming apparatus configured in this way, the sheets 42 are separated and fed one by one from the sheet tray 2, and is fed almost vertically upwardly being guided by a guide 45 and is sandwiched therebetween. The sheet 42 is further transported by a conveyor belt 51 and a counter roller 46. A tip of the sheet 42 is further guided by a transportation guide 37 and is pressed by a tip pressing roller 49 against the conveyor belt 51, so that a conveying direction thereof is changed by angle of about 90°.

At that moment, a voltage is applied to a discharging roller 56 such that positive and negative output voltages repeat alternately. The conveyor belt 51 is thus charged to form an alternating charge voltage pattern. When it is fed onto the conveyor belt 51 charged in this way, the sheet 42 is adsorbed onto the conveying belt 51, and is transported in the scanning direction as the conveyor belt 51 moves and circulates.

By driving the printing head 34 and ejecting ink droplets onto the sheet 42 currently stopping while moving the carriage 33, an amount of one line is printed in accordance with an image signal. Then, after a prescribed amount of transportation of the sheet 42, the next line is printed. Upon receiving a printing completion signal or a signal indicating that a trailing end of the sheet 42 reaches a printing region, printing operation is terminated while the sheet 42 is ejected onto the sheet exit tray 3.

When maintenance and recovery of the nozzles of the printing head 34 is to be executed, the carriage 33 is moves to a home position opposed to the maintenance recovery mechanism 81. Then, maintaining recovery operation, such as suction of nozzles capped with the caps 82, trial discharge operation of ejecting liquid droplets not contributing to image formation, etc., is conducted. Consequently, an image can be formed by constantly discharging the droplets.

Figure 3:
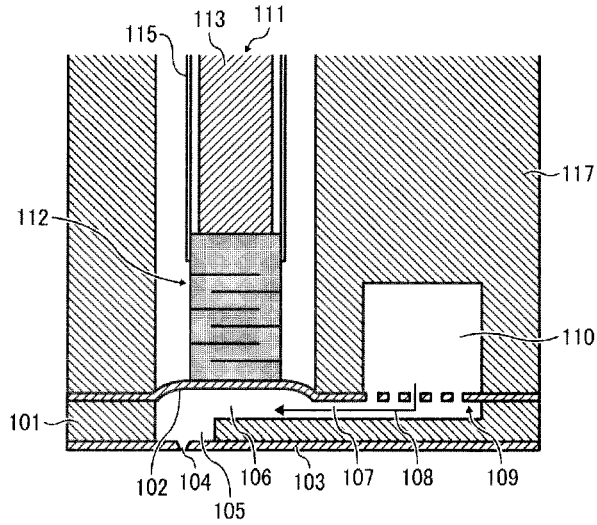
FIG. 3 is a cross-sectional view illustrating one example of a liquid discharging head constituting a printing head of the image forming apparatus when viewed in a fluid chamber longitudinal direction.
Figure 4:
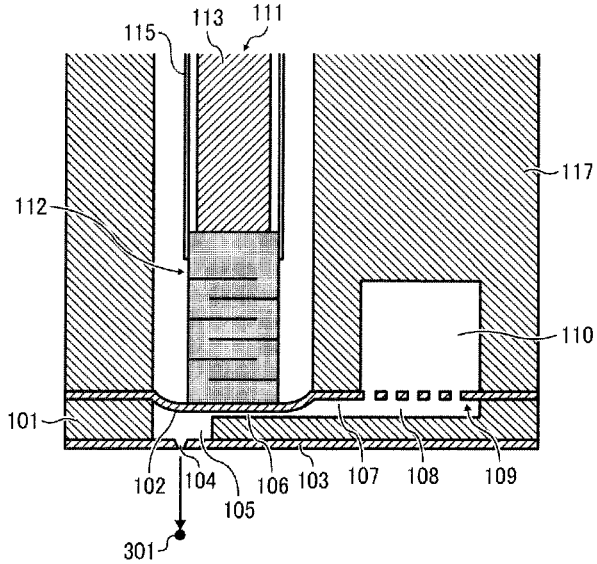
FIG. 4 is a cross-sectional view illustrating exemplary droplet discharge operation.
Figure 5:
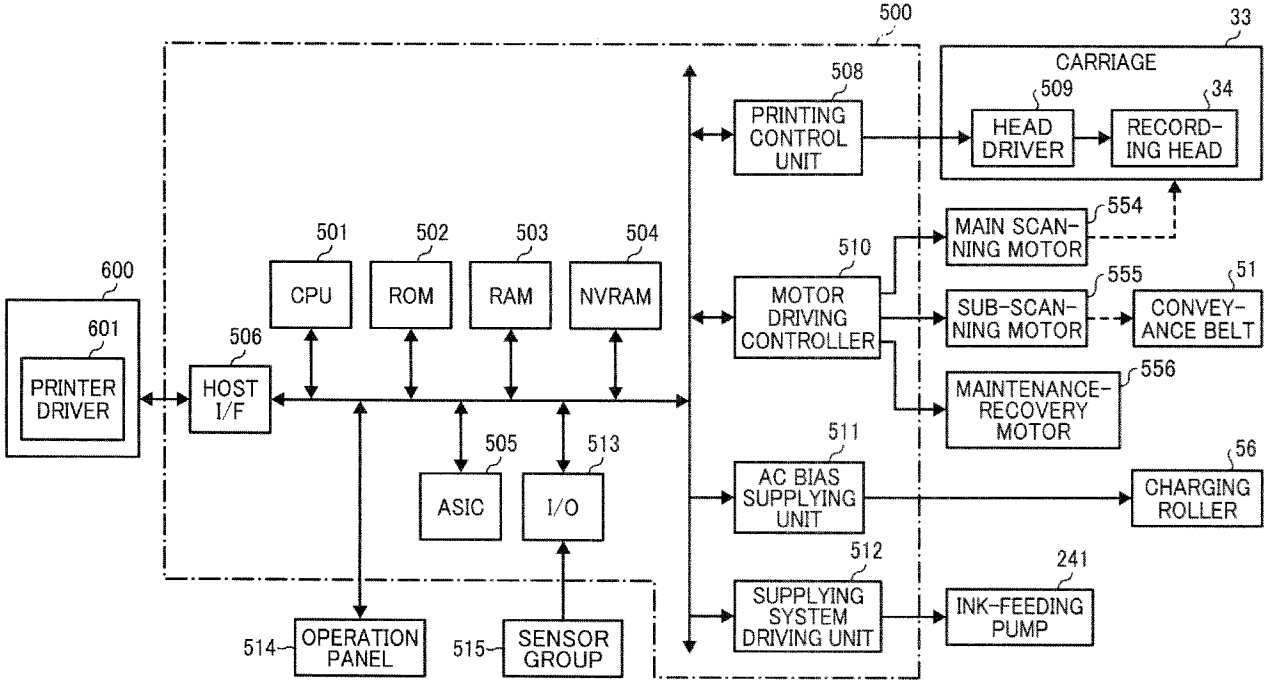
FIG. 5 is a block diagram illustrating an outline control unit included in the image forming apparatus.

Now, with reference to FIGS. 3 and 4, one example of a liquid discharging head constituting a printing head 34 is described.

This liquid discharging head is formed by connecting a flow channel plate 101, a vibration plate unit 102, and a nozzle plate 103 with each other. The liquid discharging head includes a separate liquid chamber (e.g. a compression chamber, a pressurized liquid chamber, a chamber, a separate channel, a pressure generation chamber, or the like, hereinafter simply referred to as a liquid chamber) 106 communicated through a through hole 105 with a nozzle 104 that ejects liquid droplets, a fluid resistance unit 107 to supply liquid to the liquid chamber 106, and a liquid introduction unit 108. The liquid (ink) is introduced from a common liquid chamber 110 formed on a frame unit 117 to the liquid introduction unit 108 through a filter 109 formed on the vibration plate unit 102, and is supplied to the liquid chamber 106 through the fluid resistance unit 107 from the liquid introduction unit 108.

The flow channel plate 101 is formed from a laminate of metal sheets, such as SUS, etc., and forms openings and grooves (i.e., the through hole 105, the liquid chamber 106, the fluid resistance unit 107, and the liquid introduction unit 108 or the like). The vibration plate unit 102 serves as a wall of the liquid chamber 106, the fluid resistance unit 107, and the liquid introduction unit 108, and forms a filter unit 109. It is to be noted that the material of the flow channel plate 101 is not limited to metal sheet such as SUS, etc., but may be made instead of a silicon substrate subjected to anisotropy etching.

A driving element (e.g., an actuator, a pressure generator) is bonded to a surface of the vibration plate unit 102 on the opposite side of the liquid chamber 106 to compress ink stored in the liquid chamber 106 and generate energy capable of discharging droplets from the nozzle 104. The driving element is a columnar stack-type piezoelectric member 112 as an electro-mechanical conversion element. One end of the piezoelectric member 112 is connected to a base 113. Further, an FPC 115 is connected to the piezoelectric member 112 to communicate a driving waveform. Hence, with these devices, a piezoelectric actuator 111 is collectively established.

Here, the piezoelectric member 112 in used in a d-33 mode to expand and contract in a direction perpendicular to the laminated direction in this example. However, a d-31 mode is also good to expand and contract in the direction perpendicular to the laminated direction.

In the thus-configured liquid discharging head, when a voltage applied to the piezoelectric member 112 is decreased from a reference voltage Ve, the piezoelectric member 112 contracts, and the vibration plate unit 102 is deformed and the volume of the liquid chamber 106 increases as shown in FIG. 3. Subsequently, the piezoelectric member 112 is expanded by increasing the voltage applied to the piezoelectric member 112 in the laminated direction as shown in FIG. 4, and the vibration plate unit 102 is deformed toward the nozzle 104 and the volume of the liquid chamber 106 is decreased. Therefore, ink is compressed and the liquid droplet is discharged from the nozzle 104 and the ink flows into the liquid chamber 106. Subsequently, the piezoelectric member 112 is expanded by increasing the voltage applied to the piezoelectric member 112 in the laminated direction as shown in FIG. 4, and the vibration plate unit 102 is deformed toward the nozzle 104 and the volume of the liquid chamber 106 is decreased. Therefore, ink is compressed and the liquid droplet is discharged from the nozzle 104.

Further, since the vibration plate unit 102 returns to an initial position and the liquid chamber 106 expands so that negative pressure is generated when the voltage applied to the piezoelectric member 112 returns to the reference voltage Ve, the ink is supplied to the liquid chamber 106 from the common liquid chamber 110. Consequently, after vibration of the meniscus surface of the nozzle 104 attenuates and is stabilized, a process goes to a preparation step for discharging the next droplet.

Figure 6:
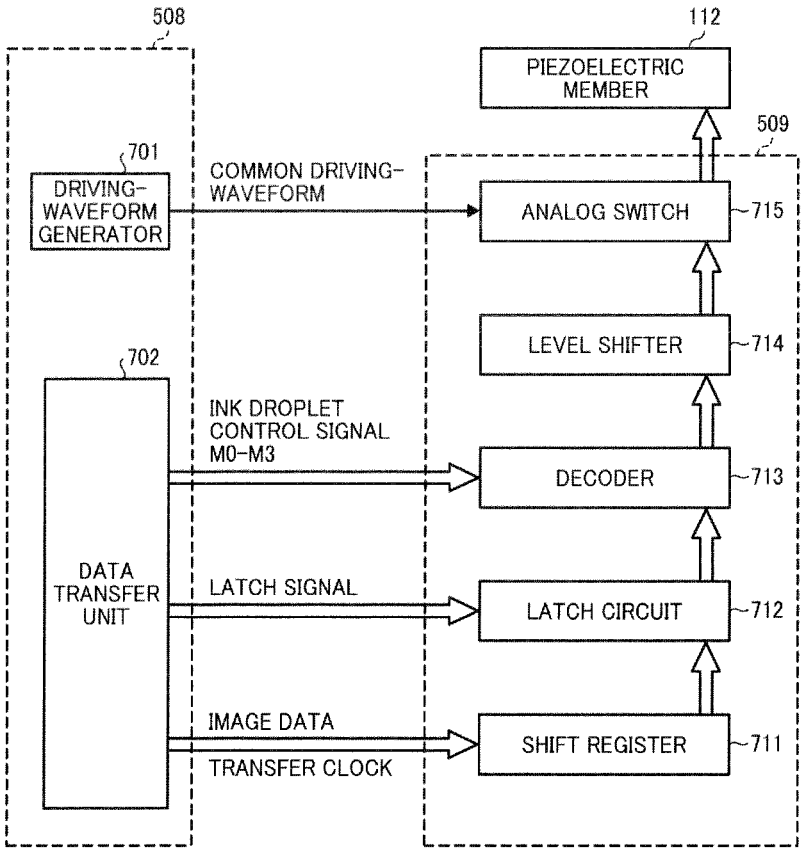
FIG. 6 is a block diagram illustrating one example of a head driver and a printing control unit in the control unit.

Now, with reference to FIG. 6, a control unit of the image forming apparatus is described.

The control unit 500 includes a CPU 511 governing general control of the entire system, a ROM 502 including static data, such as various programs including programs run by the CPU 511, etc., a RAM 503 to temporarily store image data or the like, a rewritable non-volatile memory 504 to hold data even when a power supply is interrupted, and an ASIC 505 to execute various signal processing for image data, image processing, such as sorting, etc., and processing of input and output signals to control the entire system.

The control unit 500 further includes a data transfer device for controlling and driving the printing head 34, a printing control unit 508 including a driving signal generator, and a head driver (e.g. a driver IC) 509 to drive the printing head 34 disposed on the carriage 33. The control unit 500 further includes a main scanning motor 554 to cause the carriage 33 to move and scan, a sub-scanning motor 555 to circulate the conveying belt 51, and a motor-driving unit 510 to drive a maintenance recovery motor 556 and a suction pump 812 or the like, move a maintenance recovery mechanism 81, and operate the cap 82 and a wiper 83. The control unit 500 also includes an AC bias supplying unit 511 to supply an AC bias to the charging roller 56, and a supply system driving unit 512 to drive a liquid pump 241.

Further, an operation panel 514 is connected to the control unit 500 to receive inputs and display information necessary for the system.

The control unit 500 includes an I/F 506 for communicating signals and data via a cable or a network with a host system including an host information processor, such as a personal computer, etc., an image reader, such as am image scanner, etc., and an imaging device, such as a digital camera, etc.

The CPU 501 of the control unit 500 reads out and parses print data stored in a reception buffer included in the I/F 506. The CPU 501 then executes necessary image processing and reordering of data or the like in the ASIC 505 and transfers image data thus processed from the printing control unit 508 to the head driver 509. Further, dot pattern data to output an image can be generated in either a printer driver 601 provided in the host 600 or the control unit 500.

The printing control unit 508 transfers the above-described image data as serial data, and outputs a transfer clock, a latch signal, and a control signal required in transferring image data and finalizing the transferring thereof to the head driver 509. Further, the printing control unit 508 includes a driving signal generation unit composed of a D/A converter to apply D/A conversion to pattern data of a driving pulse stored in the ROM, a voltage amplifier, and a current amplifier etc., and outputs to a driving signal consisting of one or multiple driving pulses to the head driver 509.

The head driver 509 selects a driving pulse constituting a driving waveform given from the printing control unit 508 based on image data serially entered corresponding to one line of the printing head 34, and provides the selected driving pulse to the piezoelectric member 112 (i.e., a pressure generator) that generates energy to drive the printing head 34 to discharge a droplet therefrom. At that moment, by appropriately selecting a part or all of pulses constituting the driving waveform or a part or all of waveform elements constituting the driving pulse, dots of different sizes, for example, a large droplet, a medium droplet, and a small droplet or the like can be separately discharged.

The I/O unit 513 obtains information from various sensors as a sensor group 515 installed in the system, and extracts and utilizes necessary information in controlling a printer and controls the printing control unit 508, the motor-driving unit 510, and the AC bias supplying unit 511. As the sensor group 515, an optical sensor for detecting a position of a sheet, a thermistor to monitor cabin temperature, a sensor to monitor a voltage of the discharging belt, and an internet lock switch for detecting opening and closing of a cover are exemplified. The I/O unit 513 can process various information pieces from the sensors.

Now, with reference to the block diagram of FIG. 6, one example of the printing control unit 508 and the head driver 509 is described more in detail.

The printing control unit 508 includes a driving waveform generation unit 701 that generates and outputs a driving waveform (i.e., a common driving waveform) consisting of multiple pulses (i.e., driving signals) per printing cycle (i.e., one driving cycle) during image formation, and a data transfer unit 702 that outputs image data of 2-bit (gradation signals 0, 1) in accordance with a print image, a clock signal, droplet control signals M0 to M3, and a latch signal (LAT).

Each of the droplet control signals is a 2-bit signal to instruct an analog switch 715 as a switching device of the head driver 209 to open and close at every droplet as described later more in detail. The droplet control signal is turned to an H (High) level (i.e. ON) by a pulse or a waveform element to be selected synchronizing with a printing cycle of the common driving waveform, and is tuned to be an L (low)-level (i.e., OFF) when the pulse or the waveform element is not selected.

The head driver 509 includes a shift register 711 to receive inputs of a transfer clock (i.e., a shift clock) from the data transfer unit 702 and serial image data (e.g. gradation data: 2-bit/channel (nozzle)), a latch circuit 712 to latch each resist value of the shift register 711 based on a latch signal, a decoder 713 to decode gradation data and control signals M0 to M3 and outputs decoding result, a level shifter 714 to convert a logic level voltage signal of the decoder 713 into an operable level for an analog switch 715, and the analog switch 715 turned on and off (i.e., open/close) by an output of the decoder 713 given via the level shifter 714.

The analog switch 715 is connected to a selection electrode (e.g. a separate electrode) of each piezoelectric member 112, and receives an input of a common driving waveform Pv from the driving waveform generation unit 701. Therefore, when the analog switch 715 is turned on in accordance with the result of decoding the image data (i.e., gradation data) and the control signals M0 to M3 transferred in a serial state in the decoder 713, a prescribed pulse constituting the common driving waveform Pv (or the waveform element) passes therethrough (i.e., selected) and is applied to the piezoelectric member 112.

Now, a driving waveform of the first embodiment of the present invention is described with reference to FIGS. 7 and 8.

Here, a driving pulse represents a pulse as an element constituting a driving waveform. A discharging pulse represents a pulse applied to a pressure generator to discharge a droplet. A non-discharging pulse represents a pulse applied to the pressure generator but not to discharge ink droplets (i.e., only to flow ink stored in the nozzle) therefrom.

In this embodiment, a driving waveform including discharging pulses to discharge droplets of three sizes (e.g. a large droplet, a medium droplet, a small droplet) is employed as one example. A driving waveform (i.e., a common driving waveform) PV is outputted from the driving waveform generation unit 701 as shown in FIG. 7. This driving waveform Pv is generated including multiple driving pulses P1 to P5 in time series per printing cycle (i.e., driving cycle) synchronizing with a reference signal. The reference signal is outputted corresponding to a position of the carriage 33 in a main scanning direction in accordance with density of an image to be formed.

Figure 8:
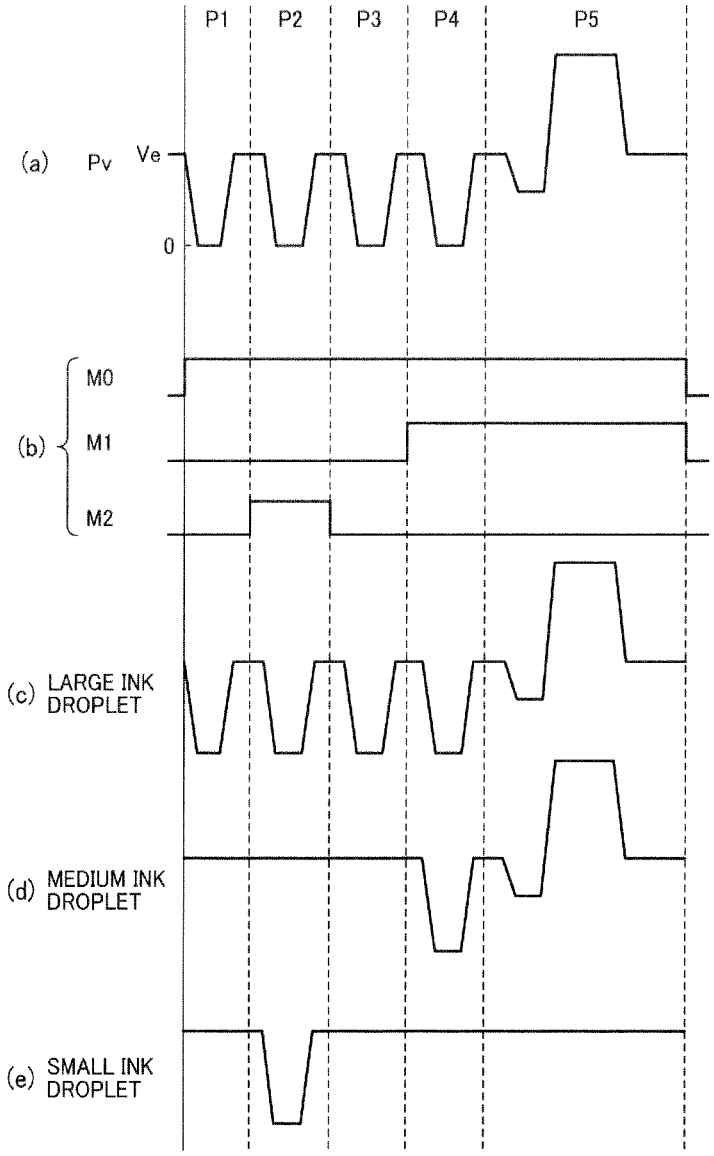
FIG. 8 is a diagram illustrating a relation between a size of droplet discharged and a selected driving waveform.

Further, the droplet control signals M0 to M2 (M3 is not used) shown in FIG. 8 are outputted from the data transfer unit 702. The droplet control signal M0 selects the driving pulses P1 to P5 in the driving waveform Pv shown in FIG. 8A and generates a discharging pulse for large droplet use as shown in FIG. 8C. The droplet control signal M1 selects the driving pulses P4 to P5 in the driving waveform Pv and generates a discharging pulse for medium droplet use as shown in FIG. 8D. Further, the droplet control signal M2 selects the driving pulse P2 in the driving waveform Pv and generates a discharging pulse for small droplet use as shown in FIG. 8E.

In other words, the driving waveform PV mainly consists in four or more driving pulses in this embodiment, and is able to discharge droplets of more than three different sizes. The largest droplet is discharged using three or more (here five) driving pulses in the driving waveform PV including the final driving pulse P5.

Figure 7:
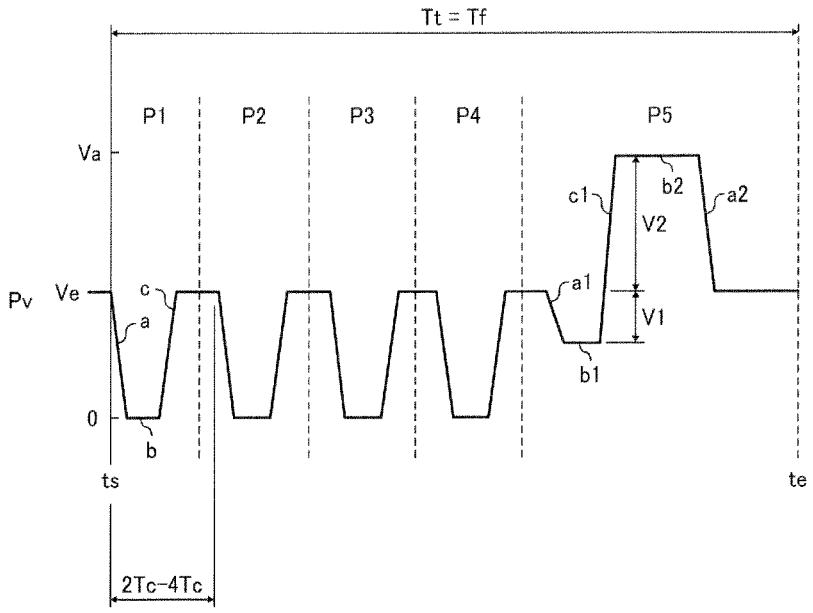
FIG. 7 is a diagram illustrating a driving waveform of a first embodiment of the present invention.

Here, as shown in FIG. 7, the total time period Tt starting from an output starting point "ts" of the driving pulse P1 until a completion point "te" of the driving pulse P5 in the driving waveform Pv is equalized to the maximum driving cycle Tf causing the maximum driving frequency "f" capable of discharging the largest droplet from the head driven by the driving waveform Pv.

However, considering a data transfer time period needed for a printing process and a mechanical delay time period caused in actual printing, the total time period Tt is preferably equal or less than the driving period Tf.

Further, the driving pulses P1 to P4 includes an expansion waveform element "a" falling down from a reference voltage Ve to inflate the liquid chamber 106, and a holding waveform element "b" for holding a voltage generated after falling down for a certain time period, and a contraction waveform element "c" rising up until the reference voltage Ve to contract the liquid chamber 106 and discharge a droplet therefrom. Hereinafter, a process applying an expansion waveform element is referred to as an expansion process, that applying a holding waveform element is referred to as a holding process, and that applying contraction waveform element is referred as a contraction process.

The driving pulse P5 includes a first expansion waveform element "a1" falling down from the reference voltage Ve to slightly expand the liquid chamber 106, a first holding waveform element "b1" for holding a voltage generated after falling down for a certain time period, a contraction waveform element "c1" rising up until the voltage Va over the reference voltage Ve to contract the liquid chamber 106 and discharge a droplet therefrom, a second holding waveform element "b2" for holding a voltage generated after rising for a certain time period, and a second expansion waveform element "a2" falling down until the reference voltage Ve.

In the second expansion process applying the second expansion waveform element "a2" of the driving pulse P5, the liquid chamber 106 is slowly expanded once again after discharging a droplet to let nozzle meniscus enter the nozzle 104. At that time, the time period for the second expansion process is designated longer than that in the first expansion process for applying the first waveform element "a1". Hence, residual vibration of the meniscus after entrainment thereof can be effectively reduced, and variations in velocity and amount of small droplets discharged based on a driving pulse P2 in the next driving cycle can be decreased.

Now, a voltage peak value of the final driving pulse P5 is described. A voltage peak value V1 applied in the first expansion process (i.e., the first expansion waveform element "a1") of the driving pulse P5 is less than a voltage peak value V2 applied in the contraction process (i.e., the waveform contraction element "c1") to discharge a droplet. The ratio V1/V2 is preferably less than about ⅓, and is more preferably about ⅓ to about ⅕. Hence, much more ink stored in the leading end of a nozzle 104 can be discharged, and the amount of liquid droplets can be increased.

Because ink viscosity changes in accordance with ambient temperature around the head, the voltage peak values V1 and V2 are preferably changed in accordance with a change in ambient temperature. Hence, a variation in velocity and discharge amount of droplets caused by the change in environment can be minimized. Further, depending on a degree of a voltage or a time period in each process, an ink column so called a satellite droplet or ink droplet tailing can be shorted.

Figure 9:
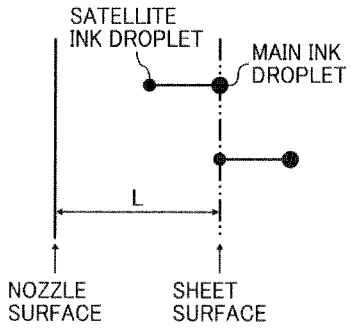
FIG. 9 is a diagram illustrating a length of a satellite droplet.
Figure 10:
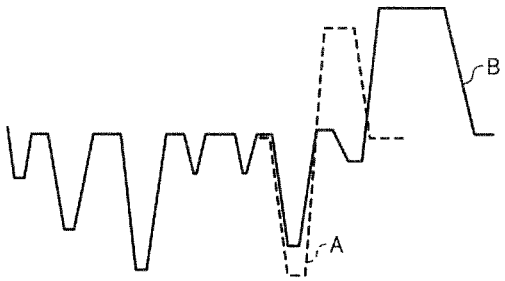
FIG. 10 is a diagram illustrating a driving waveform used in measuring the length of the satellite droplet of FIG. 11.
Figure 11:
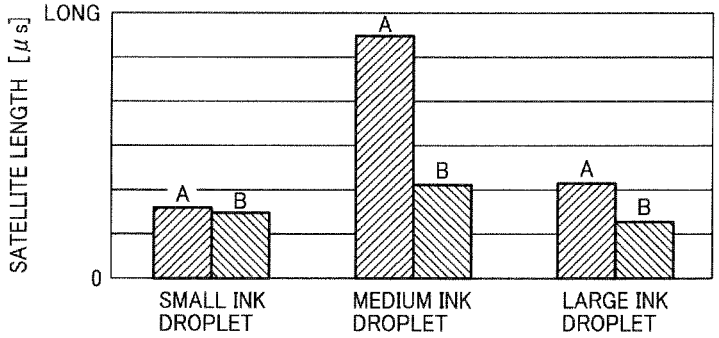
FIG. 11 is a diagram illustrating a result of the measurement of a length of a satellite droplet.

Now, with reference to FIGS. 9 to 11, a relation between a length of a satellite droplet and a voltage peak value of a driving pulse P5 is described.

First of all, with reference to FIG. 9, a length of a satellite droplet is described. Some droplets discharged from the nozzle surface (i.e., a surface having an opening of a nozzle 104) become main and satellite droplets. A time period from when the main droplet reaches a position of a distance L until when the end most of the satellite droplet passes through the position of the distance L is regarded as a length of the satellite droplets.

In such a condition, small to large ink droplets are discharged based on driving waveforms "A" and B shown in FIG. 10, and a length of each satellite droplet is measured. Here, the rate of voltage peak values V1/V2 of the driving waveform B shown by solid line is approximately ⅓ of that of the driving waveform "A" shown by dashed line in FIG. 10. A measurement result of the satellite droplet is shown in FIG. 11, wherein a reference "A" represents the driving waveform "A" and a reference "B" represents the driving waveform B.

As seen from FIG. 11, the length of the satellite droplet of especially medium and large droplets generated based on the driving waveform B is shorter. In general, the larger a size of the flying droplet, such as medium and large droplet, etc., the greater the energy provided to the liquid chamber 106. Therefore, a length of the satellite droplet increases, and image quality deteriorates. Accordingly, the last driving pulse P5 becomes critical.

Now, an exemplary positional arrangement of the driving pulse P2 included in the above-described driving waveform for small droplet discharging use is described with reference to FIGS. 12 to 14.

Figure 12:
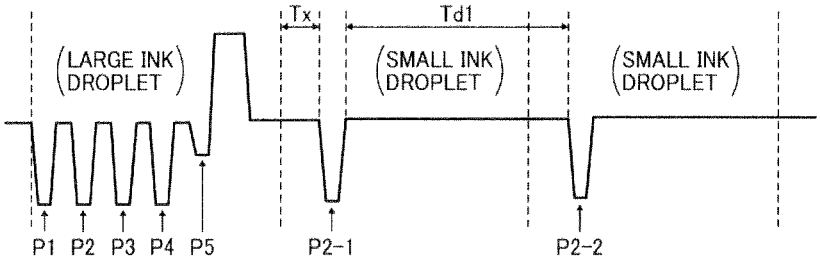
FIG. 12 is a diagram illustrating a position of a driving pulse for a small droplet use.

First, FIG. 12 illustrates a driving example, when a large droplet is discharged in a precedent driving cycle, and only a driving pulse P2 for small droplet use is continuously applied thereafter in a latter driving cycle.

Here, a time period (i.e., a pulse interval) from completion of application of the final driving pulse P5 in the precedent driving cycle up to a driving pulse P2-1 for small droplet use in the subsequent driving cycle is represented by Tx, and that between the driving pulse P2-1 and a driving pulse P2-2 in a subsequent driving cycle is represented by Td1.

Figure 13:
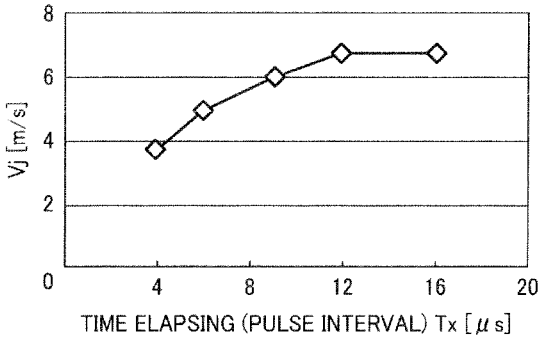
FIG. 13 is a diagram illustrating one example of a relation between a time period Tx of FIG. 12 and a result of measuring a droplet velocity.
Figure 14:
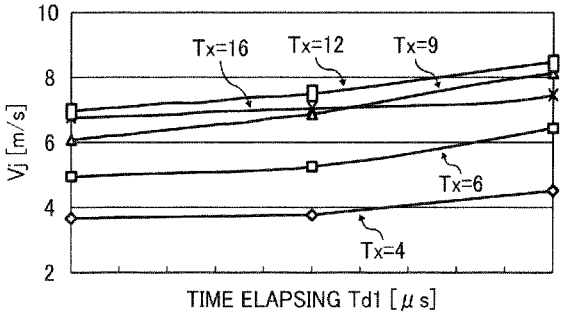
FIG. 14 is a diagram illustrating one example of a relation between each of time periods Td1 and Tx of FIG. 12 and a result of measuring a droplet velocity.

Then, a droplet velocity Vj of each of small droplets discharged by the driving pulses P2-1 and P2-2 is measured and obtained as shown in FIGS. 13 and 14.

Specifically, FIG. 13 shows a result of measurement of a velocity Vj of the small droplet when the time period Tx is changed. As shown there, when the time period Tx is increased, the droplet velocity Vj gradually increases right after the end of the driving pulse P5, and reaches about 7 m/±1 m/s when the Tx is approximately 8 μs or more. Whereas, when the time period Tx is 12 μs or more, variation in the velocity Vj almost calms don becoming flat. Specifically, vibration of a meniscus in the nozzle 104 calms down.

FIG. 14 shows an exemplary result of measuring a droplet velocity Vj when the time period Tx is changed in relation to the time period Td1.

Also understood from the result of this, it is true that the variation in droplet velocity Vj decreases when the time period Tx is approximately 8 μs or more. In particular, when the time period Td1 becomes the maximum driving cycle Tf of the head, the variation in droplet velocity Vj becomes least. Specifically, when the time period Tx is 8 μs or more, variation in droplet velocity Vj of a small droplet may be always relatively low even if the small droplet is discharged after the large droplet discharged with the maximum driving frequency "f".

Here, a natural vibration period (i.e., a natural period) Tc of a liquid chamber 106 of a liquid discharging head used in experiment is approximately 4 μs. Accordingly, the time period Tx ranges from about 2×Tc to about 4×Tc. Further, it is known from FIGS. 13 and 14 that when the time period Tx is about 12 μs or more, i.e., it ranges from about 3×Tc to about 4×Tc, the variation in droplet velocity Vj decreases.

In this way, by outputting a driving pulse for discharging the smallest droplet (i.e., a small droplet in the various embodiments) within the time period ranging from about 2×Tc to about 4×Tc, preferably, about 3×Tc to about 4×Tc, after a driving waveform Pv starts being outputted, the Variation in both velocity and amount of droplets of the small size can be reduced when a natural vibration period of the separate liquid chamber is Tc.

Figure 15:
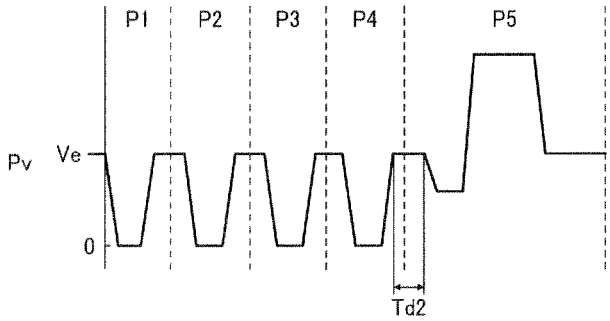
FIG. 15 is a diagram illustrating a position of a driving pulse for a medium droplet use.
Figure 17:
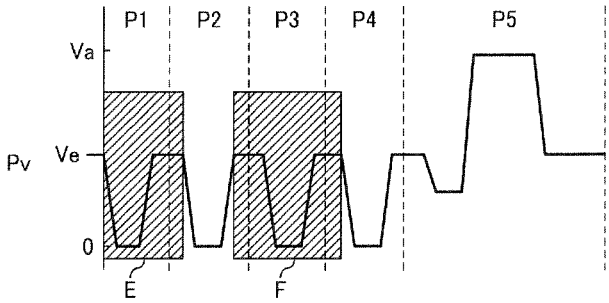
FIG. 17 is a diagram illustrating a positional relation between small, medium, and large droplet use driving pulses.

Now, with reference to FIGS. 15 and 17, the driving pulses P4 and P5 for medium droplet discharging use are described more in detail.

As described earlier, the medium droplet is discharged using the final and the immediately preceding driving pulses P5 and P4. That is, pressure in the liquid chamber increases when a driving pulse is continuously applied as the large droplet is discharged, and accordingly a length of a satellite droplet increases as the large droplet. Further because, the same effect of the variation caused when the small droplet is discharged immediately after the large droplet similarly occurs when a medium droplet is discharged thereafter.

Therefore, a time period (i.e., interval) Td2 starting immediately after the end of the driving pulse P4 until a start point of the driving pulse P5 shown in FIG. 15 becomes critical.

Figure 16:
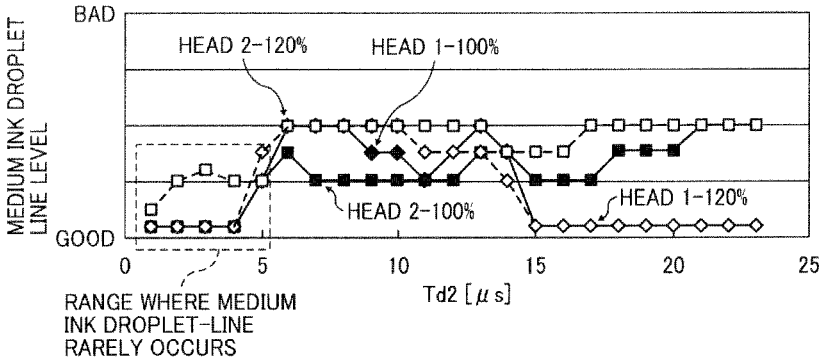
FIG. 16 is a diagram illustrating one example of a relation between a time period Td2 of FIG. 15 and a result of measurement of a line generation level.

FIG. 16 illustrates a result of measuring a linearity of flying droplets when the time period Td2 between the driving pulses P4 and P5 is changed (per head). The linearity of flying droplets represents a level of a defective image called a medium droplet line caused by uneven interval between ruled lines on a print medium.

The measurement result is obtained by changing a voltage ratio (e.g. 100%, 120%) between two heads (34*a* and 34*b*) with a prescribed voltage margin. It is known that when Td2 is equal to or less than 5 μs, the linearity is stable.

FIG. 17 illustrates positional relations between a driving pulse P2 for small droplet use, and driving pulses P4 and P5 for medium droplet use included in a driving waveform. When a driving waveform Pv is generated within a time period of 1/f (second), wherein "f" represents the maximum driving frequency of the head, a prescribed driving pulse (e.g. a non-droplet discharging pulse) capable of preventing both increase in viscosity of an ink droplet in a meniscus and variation in velocity Vj and volume Mj thereof can be inserted in a region (i.e., a shade region E) equal to or less than 8 μs before a small droplet portion and that (i.e., a shade region F) generating small and medium droplets in the driving pulse.

Figure 18:
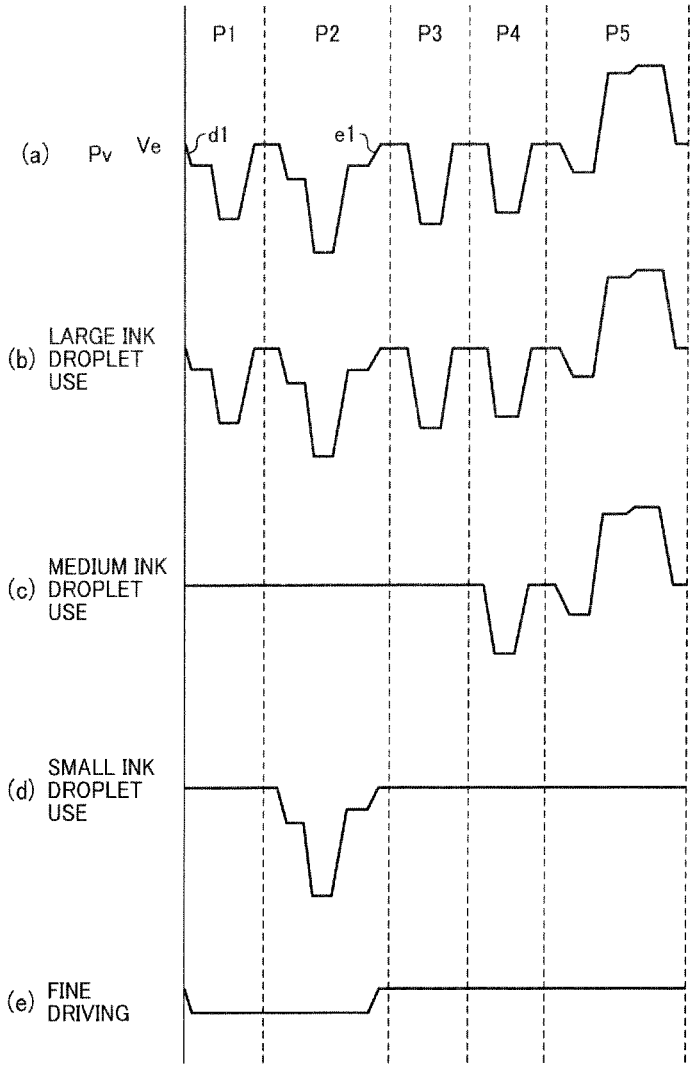
FIG. 18 is a diagram illustrating another driving waveform according to a second embodiment of the present invention.

Now, another driving waveform of a second embodiment of the present invention is described with reference to FIG. 18.

In this embodiment, (it is premised that) a driving waveform is applied to a head with a natural period Tc of about 4.3 μs. In the driving waveform, a small droplet is discharged utilizing a driving pulse P2, whereas a medium droplet is generated using driving pulses P4 and P5 again. Further, a large droplet is generated using all of the driving pulses from P1 to P5. Further, micro drives (i.e., non-droplet discharging pulses) are generated by selectively employing a waveform element d1 at a first stage of a falling down part of the driving pulse P1 and a waveform element e2 at a second stage of a rising part of the driving pulse P2, respectively.

Here, the driving pulses P1 and P3 are additionally provided to produce a large droplet. Hence, variation of small and medium droplets discharged immediately after the large droplet is reduced, so that fine image quality can be maintained.

Figure 19:
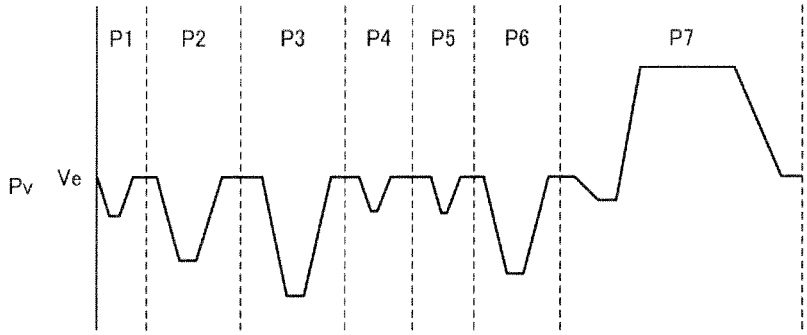
FIG. 19 is a diagram illustrating yet another driving waveform according to a third embodiment of the present invention.

Now, yet another driving waveform of a third embodiment of the present invention is described with reference to FIG. 19.

In this embodiment, (it is premised that) a driving waveform is applied to a head with a natural period Tc of about 3 μs. The driving waveform is eventually determined in view of variation in satellite droplet and/or droplet velocity Vj. Further, a small droplet is generated using a driving pulse P3, and a medium droplet is generated by using driving pulses P4 to P7. Whereas a large droplet is generated using all of the driving pulses P1 to P7.

A positional relation of driving pulses for small and medium droplets in a driving waveform is substantially the same in each of the second and third embodiments as that described earlier.

In the third embodiment, a voltage of a driving pulse positioned in front of a driving pulse for a small droplet is lower than that for the small droplet. However, such a previous driving pulse can be a non-droplet discharging pulse.

Further, a driving pulse inserted between the driving pulses for small and medium droplet uses has a smaller voltage than the driving pulse for the small droplet use. This driving pulse also prevents increasing in viscosity of ink in a meniscus and controls an amount of droplets when a large droplet is discharged.

In the above-described various embodiments, a sheet is not limited to material made of "paper" and includes an OHP sheet, cloth, glass, and a substrate, or the like. Specifically, the sheet includes every material, to which an ink droplet or the other liquid can adhere, such as a printing media, a printing sheet, a printing sheet, etc. Further, it is premised in the above-described various embodiments that image formation, printing, printing, mark photographing, duplicating are recognized as synonymous with each other.

Further, the image forming apparatus means a system that forms an image by ejecting liquid onto a medium, such as paper, yarn, fiber, cloth, leather, metal, plastic, glass, wood, ceramics, etc. Further, the image formation means an operation to provide not only a meaningful image, such as a character, a figure, etc., but also a meaningless image, such as a pattern, etc., onto a medium. Specifically, the image formation means that droplets are simply landed on the medium.

Further, the "ink" is not limited material called ink unless is particularly referred to, and is used as a generic term of substance capable of forming an image, such as printing liquid, fixing processing liquid, ordinary liquid, etc. Accordingly, a DNA sample, a resist, pattern material, and resin or the like are included as an example.

Further, the "image" is not limited to a flat state and includes an image given on a three-dimensional thing. Further, the image includes a solid image in a three-dimensional shape.

Further, unless otherwise especially limited thereto, the image forming apparatus includes both serial-type and line-type image forming apparatuses.

Hence, according to one embodiment of the present invention, variation in velocity and amount of a small ink droplet discharged from a head can be reduced.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

a printing head unit including:

multiple nozzles to eject liquid droplets;

multiple separate liquid chambers communicating with the multiple nozzles, respectively;

a common liquid chamber to supply liquid to the multiple separate liquid chambers; and a pressure generator to generate pressure to compress the liquid stored in the multiple separate liquid chambers;

a driving waveform generator to generate and output a driving waveform having at least four driving pulses per driving cycle arranged in chronological order; and a selector to select and apply at least one of the multiple driving pulses included in the driving waveform outputted from the driving waveform generator to the pressure generator to cause the printing head unit to selectively discharge liquid droplets of at least three different sizes, wherein three or more driving pulses including a final driving pulse included in the at least four driving pulses at the end of the driving waveform discharges a biggest liquid droplet, and a micro-driving pulse included therein discharges a smallest droplet, wherein the micro-driving pulse is outputted within a time period of from about 2×Tc to about 4×Tc after the driving waveform starts being outputted when Tc represents a natural vibration period of the liquid chambers of the printing head.

2. The image forming apparatus as claimed in claim 1, wherein the micro-driving pulse is outputted within a time period of from about 3×Tc to about 4×Tc after the driving waveform starts being outputted.

3. The image forming apparatus as claimed in claim 1, wherein the final driving pulse includes:

a first expansion waveform element used to increase a volume of the separate liquid chamber;

a first holding waveform element to hold the separate liquid chamber in an expanded state;

a contraction waveform element to decrease the volume of the separate liquid chamber eject a droplet therefrom;

a second holding waveform element to hold the separate liquid chamber in a contracted state; and a second expansion waveform element to return a meniscus to the separate liquid chamber.

4. The image forming apparatus as claimed in claim 1, wherein the driving waveform includes a last driving pulse and an immediately preceding driving pulse to collectively discharge a droplet of a medium size intermediate between sizes of the smallest droplet and the biggest droplet, wherein a starting point of the immediately preceding driving pulse follows a starting point of the driving pulse used to discharge the smallest droplet by a time period of about 2×Tc or more.

5. The image forming apparatus as claimed in claim 4, wherein an interval between starting points of the last driving pulse and the immediately preceding driving pulse ranges from about 0.25×Tc to about 1.0×Tc.

6. A liquid droplet ejection system comprising:

a printing head unit including:

multiple nozzles to eject liquid droplets;

multiple separate liquid chambers communicating with the multiple nozzles, respectively;

a common liquid chamber to supply liquid to the multiple separate liquid chambers; and a pressure generator to generate pressure to compress the liquid stored in the multiple separate liquid chambers;

a driving waveform generator to generate and output a driving waveform having at least four driving pulses per driving cycle arranged in chronological order; and a selector to select and apply at least one of the multiple driving pulses included in the driving waveform outputted from the driving waveform generator to the pressure generator to cause the printing head unit to selectively discharge liquid droplets of at least three different sizes, wherein three or more driving pulses including a final driving pulse included in the at least four driving pulses at the end of the driving waveform discharges a biggest liquid droplet, and a micro-driving pulse included therein discharges a smallest droplet, wherein the micro-driving pulse is outputted within a time period of from about 2×Tc to about 4×Tc after the driving waveform starts being outputted when Tc represents a natural vibration period of the liquid chambers of the printing head.

7. The liquid droplet ejection system as claimed in claim 6, wherein the micro-driving pulse is outputted within a time period of from about 3×Tc to about 4×Tc after the driving waveform starts being outputted.

8. The liquid droplet ejection system as claimed in claim 6, wherein the final driving pulse includes:

a first expansion waveform element used to increase a volume of the separate liquid chamber;

a first holding waveform element to hold the separate liquid chamber in an expanded state;

a contraction waveform element to decrease the volume of the separate liquid chamber to eject a droplet therefrom;

a second holding waveform element to hold the separate liquid chamber in a contracted state; and a second expansion waveform element to return a meniscus to the separate liquid chamber.

9. The liquid droplet ejection system as claimed in claim 6, wherein the driving waveform includes a last driving pulse and an immediately preceding driving pulse to collectively discharge a droplet of a medium size intermediate between sizes of the smallest droplet and the biggest droplet, wherein a starting point of the immediately preceding driving pulse follows a starting point of the driving pulse used to discharge the smallest droplet by a time period of about 2×Tc or more.

10. The liquid droplet ejection system as claimed in claim 9, wherein an interval between starting points of the last driving pulse and the immediately preceding driving pulse ranges from about 0.25×Tc to about 1.0×Tc.

11. A method of forming an image utilizing a printing head unit including multiple nozzles to eject liquid droplets, multiple separate liquid chambers communicating with the multiple nozzles, respectively, a common liquid chamber to supply liquid to the multiple separate liquid chambers, and a pressure generator to generate pressure to compress the liquid stored in the multiple separate liquid chambers, the method comprising the steps of:

generating and outputting a driving waveform having at least four driving pulses per driving cycle arranged in chronological order with a micro-driving pulse discharging a smallest droplet being outputted within a time period of from about 2×Tc to about 4×Tc after the driving waveform starts being outputted when Tc represents a natural vibration period of the liquid chambers of the printing head;

selecting and applying at least one of the multiple driving pulses included in the driving waveform outputted from the driving waveform generator to the pressure generator; and selectively discharging liquid droplets of at least three different including a biggest liquid droplet based on three or more driving pulses including a final driving pulse from the printing head unit.

12. The method of forming an image as claimed in claim 11, wherein the micro-driving pulse is outputted within a time period of from about 3×Tc to about 4×Tc after the driving waveform starts being outputted.

13. The method of forming an image as claimed in claim 11, wherein the final driving pulse includes:

a first expansion waveform element used to increase a volume of the separate liquid chamber;

a first holding waveform element to hold the separate liquid chamber in an expanded state;

a contraction waveform element to decrease the volume of the separate liquid chamber to eject a droplet therefrom;

a second holding waveform element to hold the separate liquid chamber in a contracted state; and a second expansion waveform element to return a meniscus to the separate liquid chamber.

14. The method of forming an image as claimed in claim 11, wherein the driving waveform includes a last driving pulse and an immediately preceding driving pulse to collectively discharge a droplet of a medium size intermediate between sizes of the smallest droplet and the biggest droplet, wherein a starting point of the immediately preceding driving pulse follows a starting point of the driving pulse used to discharge the smallest droplet by a time period of about 2×Tc or more.

15. The method of forming an image as claimed in claim 14, wherein an interval between starting points of the last driving pulse and the immediately preceding driving pulse ranges from about 0.25×Tc to about 1.0×Tc.

16. A computer readable medium storing thereon program code causing a computer to perform the steps of:

generating and outputting a driving waveform having at least four driving pulses per driving cycle arranged in chronological order with a micro-driving pulse discharging a smallest droplet being outputted within a time period of from about 2×Tc to about 4×Tc after the driving waveform starts being outputted when Tc represents a natural vibration period of the liquid chambers of the printing head;

selecting and applying at least one of the multiple driving pulses included in the driving waveform outputted from a driving waveform generator to a pressure generator; and selectively discharging liquid droplets of at least three different sizes including a biggest liquid droplet based on three or more driving pulses including a final driving pulse from the printing head unit.

17. The computer readable medium as claimed in claim 16, wherein the micro-driving pulse is outputted within a time period of from about 3×Tc to about 4×Tc after the driving waveform starts being outputted.

18. The computer readable medium as claimed in claim 16, wherein the final driving pulse includes:

a first expansion waveform element used to increase a volume of the separate liquid chamber;

a first holding waveform element to hold the separate liquid chamber in an expanded state;

a contraction waveform element to decrease the volume of the separate liquid chamber to eject a droplet therefrom;

a second holding waveform element to hold the separate liquid chamber in a contracted state; and a second expansion waveform element to return a meniscus to the separate liquid chamber.

19. The computer readable medium as claimed in claim 16, wherein the driving waveform includes a last driving pulse and an immediately preceding driving pulse to collectively discharge a droplet of a medium size intermediate between sizes of the smallest droplet and the biggest droplet, wherein a starting point of the immediately preceding driving pulse follows a starting point of the driving pulse used to discharge the smallest droplet by a time period of about 2×Tc or more.

20. The computer readable medium as claimed in claim 19, wherein an interval between starting points of the last driving pulse and the immediately preceding driving pulse ranges from about 0.25×Tc to about 1.0×Tc.

* * * * *